US005826279A

United States Patent [19]

Tencer

[11] Patent Number: 5,826,279

[45] Date of Patent: Oct. 27, 1998

[54] LINER FOR PROTECTIVE HEADGEAR

[75] Inventor: Alan I. Tencer, Coram, N.Y.

[73] Assignee: OccuNomix International, Inc., Port Jefferson, N.Y.

[21] Appl. No.: 957,154

[22] Filed: Oct. 24, 1997

[51] Int. Cl.[6] ..... A42B 3/10

[52] U.S. Cl. ..... 2/181; 2/181.4; 2/416; 2/DIG. 11

[58] Field of Search ..... 2/416, 422, 181, 2/181.2, 181.4, 183, 209.13, 63, DIG. 11

[56] References Cited

U.S. PATENT DOCUMENTS

| | | | |
|---|---|---|---|
| 1,421,139 | 6/1922 | Anderson . | |
| 2,628,361 | 2/1953 | Heyck . | |
| 2,981,955 | 5/1961 | Ruggiero . | |
| 3,280,406 | 10/1966 | Immel . | |
| 3,685,055 | 8/1972 | Militello | 2/181.4 |
| 4,468,817 | 9/1984 | Nunnery et al. . | |
| 5,058,210 | 10/1991 | Tivis | 2/181 |
| 5,088,126 | 2/1992 | Mathis . | |
| 5,265,279 | 11/1993 | Mathis . | |
| 5,317,761 | 6/1994 | Piche . | |
| 5,432,955 | 7/1995 | Plotka et al. . | |
| 5,553,326 | 9/1996 | Moore . | |
| 5,613,248 | 3/1997 | Young . | |

*Primary Examiner*—Michael A. Neas
*Attorney, Agent, or Firm*—Amster Rothstein & Ebenstein

[57] ABSTRACT

A reusable liner for lining the support harness of a safety helmet comprising a body fabricated of an absorbent material which is longitudinally elongated and terminates in enlarged opposite ends which extend generally transverse to the longitudinal axis of the liner body. The liner is further provided with a deformable mounting member which is secured within each of the enlarged opposite ends substantially coextensive therewith for removably securing the liner to the support harness of a safety helmet.

12 Claims, 2 Drawing Sheets

FIG. 5
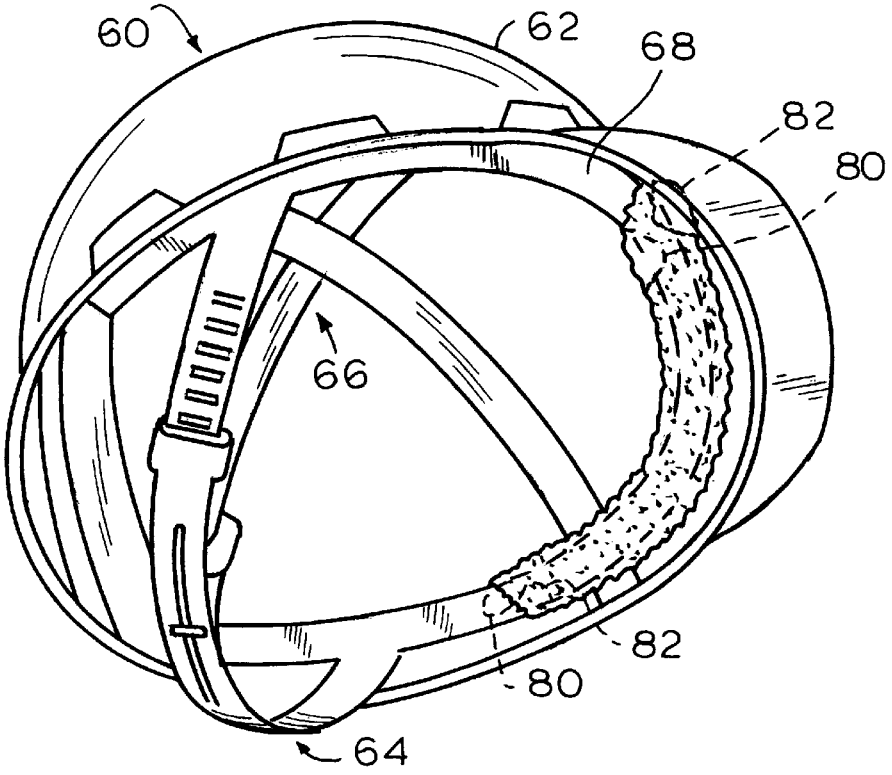
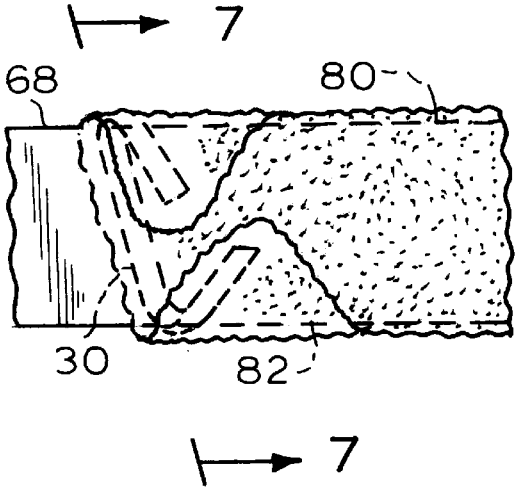
FIG. 6
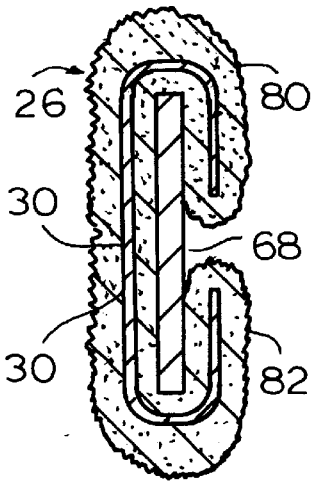
FIG. 7

LINER FOR PROTECTIVE HEADGEAR

BACKGROUND OF THE INVENTION

1. Field of the Invention

The present invention relates generally to an absorbent liner for protective headgear, and, in particular, to an absorbent liner which may be removably secured to a forehead contacting band of a support harness of a safety helmet.

2. Prior Art

The present invention, like other devices of its kind, has been designed to benefit the wearer of a safety helmet, such as a conventional hard hat used in construction sites across the country. The conventional safety helmet is generally a two piece construction comprising an outer protective shell and an internally mounted support harness for safely accommodating the head of the safety helmet wearer.

As understood, the prior art liners are intended to be used primarily with safety helmets which utilize either a four strap or six strap support harness system. In both the four and six strap systems, the support harness includes a generally circular headband which is secured to the interior of a safety helmet and a network of connected straps for preventing the top of the wearer's head from coming in direct contact with the protective shell. In some safety helmet models, the circular band may be adjustable to accommodate the head of any number of potential wearer's of the safety helmet.

While the use of a support harness system has been shown to enhance the safety characteristics of a safety helmet, it has also been found that the support harness results in some discomfort to the wearer. In particular, the support harness headband may chafe or scratch the exposed forehead of the safety helmet wearer.

To address this problem, it has been well known in the prior art to equip a support harness with a liner made of an appropriate material to provide an absorbent and cushioning barrier between the forehead of the wearer and the forehead contacting surface of the headband of the support harness.

In designing such a liner, the objective has been to provide a comfortable absorbent liner which may be reused and which is adapted to be quickly and easily secured to the support harness of most safety helmets. In pursuit of this objective, the prior art liners have been configured to have a variety of shapes for improving the fit of the liner and have utilized a variety of fastening means for removably securing the liner to the support harness of a safety helmet.

For example, U.S. Pat. No. 5,265,279 teaches a liner made of an absorbent material which is secured to the support harness of a safety helmet by means of a plurality of snap fasteners strategically positioned along the perimeter of the liner. It is a stated objective of the patented liner to have a liner body which is shaped to fit within most safety helmets without bunching or bulging. Although this liner fits well and effectively insulates the wearer's forehead, a great degree of dexterity is required to manipulate the snap fasteners around the network of straps which comprise the support harness. Consequently, the act of securing the liner to a safety helmet will require the use of two hands and even then may not be accomplished with gloved hands. Therefore, a need continues to exist for a liner which may be easily secured to a safety helmet and, if necessary, secured with a single hand.

Another example of a prior art liner is disclosed in U.S. Pat. No. 5,088,126 which discloses the use of a pressure sensitive adhesive that is applied to one side of the liner for securing that side of the liner to the support harness of a safety helmet. Although the application of the liner to the safety helmet is simplified, the liner may not be reused after its first application to a safety helmet. Thus, a new liner must be provided for each new use of the safety helmet. Accordingly, a need continues to exist for a reusable liner which is easily secured to a support harness of a safety helmet.

Yet another example of a prior art liner is illustrated in U.S. Pat. No. 2,628,361. The liner shown here comprises a band of absorbent material having a plurality of ductile metal tabs secured to an outer surface of the band of absorbent material for securing the liner to a safety helmet. As shown in the drawings, each of the ductile metal tabs are laterally spaced and disposed perpendicular to a longitudinal axis of the band of material. Although the ductile metal tabs have proven to be an effective means of securing the liner to a safety helmet, the use of the exposed externally mounted metal tabs have a number of drawbacks which may affect the comfort, absorbency and safety of the liner.

In particular, to extend the life of a reusable liner it is necessary to clean the liner, preferably after each use. To this end, it is preferable to use a conventional clothes washing machine in combination with a cleaning agent to thoroughly clean the liner. If a washing machine is used to clean a liner having exposed metal tabs, the exposure to the water and the cleaning agent would almost certainly corrode the metal tabs, leading to the disintegration of the liner material. As a result, the liner having exposed metal tabs cannot be thoroughly cleaned which ultimately shortens the life span of the liner.

Moreover, the exposed metal tabs may be warped, chipped, bent or otherwise undesirably deformed which may cause discomfort to the user and, perhaps, cause an injury to a user as might be the case where an edge or corner of the metal tab has been deformed so as to create a sharp or cutting edge.

In addition, the use of exposed metal tabs makes the liner impractical and unsafe for use in electrically hazardous areas where there exists a possibility of electrical arcing between the metal tabs and an external electrical source.

A final noted disadvantage in using exposed metal tabs which are secured to the exterior surface of a liner is that the tabs create depressions or valleys in the forehead contacting surface of the liner. The depressions or valleys, which aside from being uncomfortable, act as channels or passages through which the perspiration of a user may stream into an eye or the eyes of the user, thus making the absorbency characteristics of the liner less effective.

Thus a need continues to exist for a reusable liner made of an absorbent material which can be safely utilized in all environments, including environments where the risk of electrical arcing is present.

Still a further need exists for a liner which may be easily secured to a support system and which is adapted to be fit along the forehead contacting strap of the majority of safety helmets.

It is an object of the present invention to provide a reusable liner made of an absorbent material which is adapted to be quickly and easily mounted to a safety helmet.

It is another object of the present invention to provide a reusable absorbent liner which utilizes deformable or malleable mounting members for securing the liner to a support harness of a safety helmet.

It is a further object of the present invention to utilize deformable or malleable mounting members which are insulated with a non-conductive coating, permitting the use of the liner in an environment where the possibility of electrical arcing is present.

It is yet another object of the present invention to provide a reusable absorbent liner which is ideally configured to conform to the support system of the majority of safety helmets.

SUMMARY OF THE INVENTION

In accordance with the stated objectives and other objectives which will become apparent, the liner of the present invention has been adapted for use with the vast majority of protective headgear having a support harness, the liner of the present invention comprising a body fabricated of an absorbent material configured and dimensioned to be removably mounted within the protective headgear in a region confronting the brow of a user of the protective headgear. The body is preferably longitudinally elongated and terminates in enlarged opposite ends which extend generally transverse to the longitudinal axis of the body. The liner further includes deformable mounting members which are secured within each of the enlarged opposite ends for removably mounting the liner to the support system of the protective headgear.

Additionally, so that the liner may be used in a potentially electrically hazardous area, the deformable mounting members are preferably coated with an electrically non conductive material.

To enhance or supplement the comfort and absorbency of the liner, the liner may include a cushioning material such as a foam padding or fill which is disposed entirely within the body of the liner.

Also in keeping with the stated objectives, the enlarged ends having the deformable elements are configured to further comprise upper and lower folding tabs, which as will be explained in the description to follow, allow the liner to be accommodated within the vast majority of safety helmets.

To secure the liner to the support system of a safety helmet, the liner is manually positioned along the forehead contacting surface of a support harness headband and at least a portion of the enlarged ends including the deformable mounting members are wrapped around at least a portion of the support harness headband. To remove the liner the deformable mounting members are merely unwrapped. In this manner a liner is provided which may be easily mounted to a safety helmet and which may be used in an area where a potential electrical hazard is present.

BRIEF DESCRIPTION OF THE DRAWINGS

The above and related objects, features and advantages of the present invention will be more fully understood by reference to the following detailed description of the presently preferred, albeit illustrative, embodiments of the present invention when taken in conjunction with the accompanying drawings, wherein:

FIG. 5 is a bottom perspective view of a conventional safety helmet having a protective outer shell and support harness with the liner of the present invention attached;

FIG. 6 is a fragmentary elevational view showing a liner according to the present invention mounted to the support system of a conventional safety helmet; and FIG. 7 is a sectional view taken along the line 7—7 of FIG. 6.

DETAILED DESCRIPTION OF THE PREFERRED EMBODIMENTS

Figure 1:
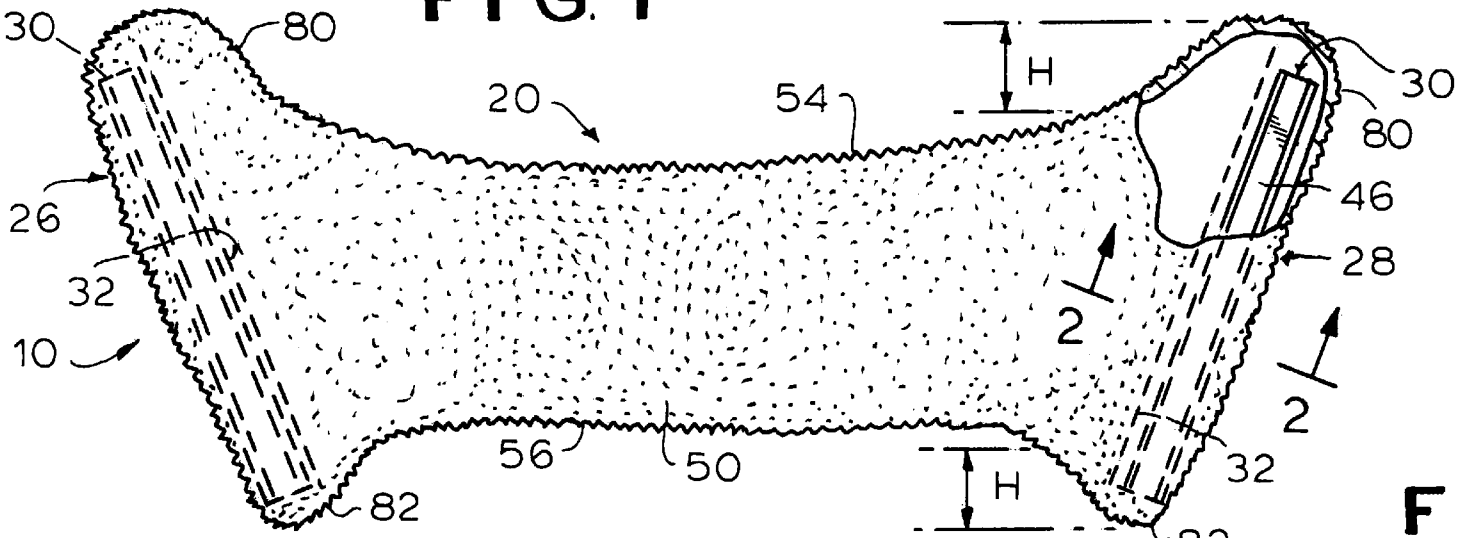
FIG. 1 is front elevational view of a first preferred embodiment of the present invention, partially in section.
Figure 2:
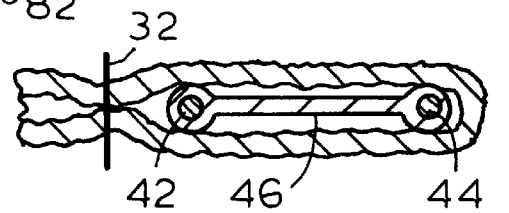
FIG. 2 is a fragmentary cross sectional view taken along the line 2—2 of FIG. 1.

Referring now to the drawings and particularly to FIGS. 1 and 2 thereof, therein illustrated is a liner in accordance with a first preferred embodiment of the present invention generally designated by the reference numeral 10. The liner 10 is comprised of a body, generally designated by the reference numeral 20, of flexible absorbent material, terminating in enlarged opposite ends 26,28. The body 20 of absorbent material is preferably comprised of a pair of identically shaped panels of absorbent material, such as terry cloth, which have been stitched along the edges to define the body 20 of absorbent material.

Although not represented in the drawings, a foam padding or soft fill having absorbent qualities may be disposed between the panels of the liner 10 in order to make the liner 10 more comfortable and absorbent. The foam padding or soft fill may be contained within only in the portion of the body 20 between the enlarged ends 26,28 or may be contained within the entire body 20, including the enlarged ends 26,28 to provide maximum comfort to the safety helmet user.

The liner 10 further comprises a deformable or malleable mounting member, generally designated as reference numeral 30 which is contained within each of the enlarged ends 26,28 of the body 20 substantially coextensive therewith and preferably disposed between the panels of absorbent material. In order to secure the deformable mounting members 30 within the body 20 of the liner 10, a transverse seam 32 may be stitched into each of the enlarged ends 26,28 to define a pocket for containing the deformable mounting member 30.

For adapting the liner 10 to be easily secured to a safety helmet, the deformable mounting member 30 preferably comprise a flat strip of ductile or malleable material. In a first preferred embodiment, the deformable mounting member 30 is characterized in having a pair of laterally spaced parallel strands of ductile or malleable wire 42,44, typically copper, enclosed within an outer covering 46.

As the strands of wire 42,44, are electrically conductive and the body 20 of absorbent material does not provide adequate electrical insulation, preferably, the covering 46 is comprised of an electrically non-conductive material for electrically insulating the wire strands 44, thus permitting the use of the liner 10 in a potentially electrically hazardous area. Where the wire strands 42,44 extend beyond the insulating covering 46 at the ends of thereof, preferably the ends are also insulated, e.g., by being dipped in a molten plastic to completely insulate wire strands 42,44.

An advantage of the present design is that the liner 10 may be cleaned using a conventional washing machine. As the deformable mounting member 30 is preferably insulated and contained entirely within the body 20 of absorbent material, it is unlikely that washing the liner 10 would corrode or corrupt the shape of the deformable mounting member 30 as might be the case where a deformable mounting member made of an exposed metal had been used. In this manner, the deformable mounting member 30 does not negatively affect the useful life of the liner 10 and does not pose as a potential hazard to the user.

Figure 3:
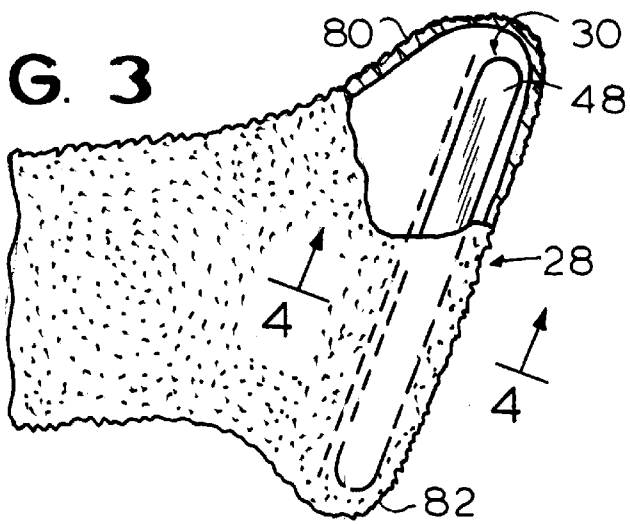
FIG. 3 is fragmentary front elevational view of a second embodiment, partially in section.
Figure 4:
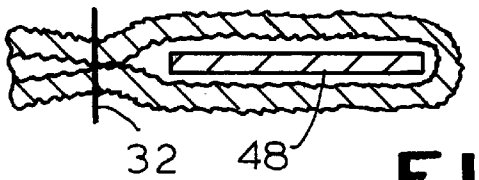
FIG. 4 is a fragmentary cross sectional view taken along the line 4—4 of FIG. 3.

Alternatively, the deformable mounting member 30 of a second preferred embodiment may comprise a ductile or malleable metal stay 48 having the general shape indicated in FIGS. 3 and 4. As the liner 10 may be used in electrically active areas, the metal stay 48 may be used provided the metal stay 48 is insulated with some type of protective non-conducting coating. It is preferable, however, to utilize the deformable mounting member 30 of the first preferred embodiment as it has the advantage of already being substantially pre-insulated.

Although the deformable mounting member 30 of the present invention can be successfully utilized to secure a body of fabric having any number of shapes, it is preferable to have a liner configured to have a shape as illustrated in FIG. 1. It has been found that the configuration represented in FIG. 1 permits the liner 10 to be secured to the vast majority of safety helmets.

In the preferred embodiment of FIG. 1, the body of absorbent material 20 includes between the enlarged ends 26,28 and elongated central area 50 having generally parallel upper and lower longitudinal edges 54,56 terminating in the enlarged ends 26,28.

As shown in FIGS. 1 and 6, the enlarged ends 26,28 which contain the deformable mounting members 30 are transversely angled with respect to the longitudinal axis of the liner 10. In this manner, the angled enlarged ends 26,28 together with the deformable mounting members 30 define laterally offset upper and lower folding tabs 80,82 for securing the liner to a safety helmet.

As further shown in FIG. 1, the lower folding tabs 82 are preferably positioned inwardly of (i.e., do not extend outwardly as far as) the upper folding tabs 80. The length of the offset distance, as measured between a vertical axis line extending through the center of an upper folding tab 80 and a similar axis line extending through the center of a lower folding tab 82, is determined by the angle of the enlarged ends 26,28 with respect to the longitudinal axis of the liner 10. Thus the steeper the slope, the greater the length of the lateral offset.

It has been found that the provision of the outwardly offset upper folding tabs 80 permit the liner 10 of the present invention to be secured to the vast majority of four and six strap safety helmets without interfering with any of the network of straps.

As illustrated in FIGS. 5, 6, and 7, to secure the liner 10 to a conventional safety helmet 60 having a protective shell 62 and a support harness 64 including a network of straps 66 and a headband 68, the liner 10 is positioned in the vicinity of the forehead contacting surface of the headband 68. At least a portion of the folding tabs 80,82 are wrapped behind the headband 68 in the area between the back surface of the headband 68 and the protective shell 62 thereby securing the liner 10 to the safety helmet. As the upper tabs 80 support the weight of the suspended liner 10, it is preferable for the upper tabs 80 to have a dimension H greater than a dimension H' of the lower tabs 82.

It should be appreciated that by transversely angling the enlarged ends 26,28, the upper and lower folding tabs 80,82 do not overlap in the area between the protective shell 62 and the back surface of the headband 68. As illustrated in FIG. 6, in a liner which has been secured to a safety helmet 60, the wrapped upper and lower folding tabs 80,82 lie adjacent each other substantially without abutting due to the lateral offset of the upper and lower folding tabs 80,82. The absence of the offset of the tabs 80,82 in the design of the liner 10 would make mounting the liner 10 to a safety helmet a much more difficult task, given the limited space available between the headband 68 and protective shell 62.

In a preferred embodiment, the liner 10 as measured between the center of each of the upper folding tabs is at least 8 inches in length and includes deformable mounting members 30 which measure approximately 4 inches from end to end.

Now that the preferred embodiments of the present have been shown and described in detail, various modifications and improvements thereon will become readily apparent to those skilled in the art. Accordingly, the spirit and scope of the present invention is to be construed broadly and limited only by the appended claims, and not by the foregoing specification.

What is claimed is:

1. A liner for use with protective headgear having a support harness, the liner comprising:

a body fabricated of an absorbent material configured and dimensioned to be removably mounted within said protective headgear in the region confronting the brow of a user of said protective headgear, said body being longitudinally elongated and terminating in enlarged opposite ends extending generally transverse to the longitudinal axis of said body; and a deformable mounting member secured within each of said enlarged opposite ends of said body and substantially coextensive therewith, said deformable mounting member being adapted to be wrapped at least partially about said support harness to removably mount said liner within said protective headgear.

2. The device of claim 1 wherein said absorbent material comprises a terry cloth fabric.

3. The device of claim 1 wherein said deformable mounting member comprises a ductile wire encapsulated within an electrically non-conductive coating, said wire being of a suitable gauge for retaining a wrapped shape about said support harness of said protective headgear.

4. The device of claim 1 wherein said deformable mounting member comprises an insulated metal stay.

5. The device of claim 1 wherein said enlarged opposite ends containing said deformable mounting members further comprise upper and lower folding tabs for wrapping partially about said support harness of said protective headgear.

6. The device of claim 1 wherein each of said enlarged opposite ends define a pocket for receiving said deformable mounting member.

7. A liner to be removably secured to a forehead contacting surface of a support harness headband of a safety helmet comprising:

front and rear panels of absorbent material, said front and rear panels being stitched together to define a body of absorbent material;

said body of absorbent material configured and dimensioned to be removably mounted to said forehead contacting portion of said headband, said body of absorbent material being elongated and terminating in enlarged opposite ends extending generally transverse to the longitudinal axis of said body, and an electrically insulated deformable mounting member completely secured between said panels of absorbent material and disposed within each of said enlarged ends substantially coextensive therewith, said deformable mounting member being configured to be wrapped at least partially about said forehead contacting surface of said headband for removably securing said liner to said safety helmet.

8. The liner of claim 7 wherein each said enlarged end includes a pocket for receiving said deformable mounting member.

9. The liner of claim 7 wherein said enlarged ends including said deformable mounting members comprise upper and lower folding tabs for removably securing said liner to said forehead contacting surface of said support harness headband of said safety helmet.

10. The liner of claim 9 wherein said upper folding tabs are laterally offset from said lower folding tabs along the longitudinal axis of said body.

11. The liner of claim 7 wherein at least a portion of said body of absorbent material further comprises a cushioning material disposed entirely between said front and rear panels.

12. A safety helmet comprising:

an outer protective shell;

a support harness mounted within said outer protective shell, said support harness including a headband having a forehead contacting surface;

a liner having a body fabricated of an absorbent material configured and dimensioned to be removably secured said safety helmet, said body being longitudinally elongated and terminating in enlarged opposite ends extending generally transverse to the longitudinal axis of said body; and a deformable mounting member secured within each of said enlarged opposite ends of said body and substantially coextensive therewith, said deformable mounting member being configured and dimensioned to be wrapped at least partially about said supporting harness to removably mount said liner to said forehead contacting surface.

* * * * *